US010379482B2

(12) United States Patent
Hidaka

(10) Patent No.: US 10,379,482 B2
(45) Date of Patent: Aug. 13, 2019

(54) IMAGE FORMING METHOD AND IMAGE FORMING SYSTEM

(71) Applicant: KONICA MINOLTA, INC., Chiyoda-ku, Tokyo (JP)

(72) Inventor: Hiroki Hidaka, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/955,081

(22) Filed: Apr. 17, 2018

(65) Prior Publication Data

US 2018/0341213 A1 Nov. 29, 2018

(30) Foreign Application Priority Data

May 23, 2017 (JP) ..... 2017-101902

(51) Int. Cl.
*G03G 15/00* (2006.01)
*G03G 15/043* (2006.01)
*G03G 15/23* (2006.01)

(52) U.S. Cl.
CPC ..... *G03G 15/6567* (2013.01); *G03G 15/043* (2013.01); *G03G 15/234* (2013.01); *G03G 15/50* (2013.01); *G03G 15/5016* (2013.01); *G03G 15/6502* (2013.01); *G03G 15/502* (2013.01)

(58) Field of Classification Search
CPC ..... G03G 15/6567; G03G 15/50; G03G 15/5016; G03G 15/6502; G03G 15/5062; G03G 15/234; G03G 2215/00561; G03G 2215/00586
See application file for complete search history.

(56) References Cited

U.S. PATENT DOCUMENTS

2002/0110380 A1* 8/2002 McIntyre ..... B41J 3/60 399/15
2005/0286922 A1* 12/2005 Oki ..... H04N 1/0058 399/75
2006/0159480 A1* 7/2006 Mima ..... B41J 3/60 399/82
2017/0142286 A1* 5/2017 Hirota ..... H04N 1/3873

FOREIGN PATENT DOCUMENTS

JP 2016057542 * 4/2016
JP 2016057542 A 4/2016

* cited by examiner

*Primary Examiner* — Sandra Brase
(74) *Attorney, Agent, or Firm* — Holtz, Holtz & Volek PC

(57) ABSTRACT

An image forming method for an image forming system that includes an image former that performs both side printing for one sheet and a sheet feeding apparatus and a tray (sheet feeder) that stores a sheet to be fed to the image former, includes detecting a state change of the sheet feeder; and executing adjustment for a formation position of an image to be subjected to both side printing in a case where a state change of the sheet feeder has been detected.

18 Claims, 11 Drawing Sheets

IMAGE FORMING METHOD AND IMAGE FORMING SYSTEM

CROSS-REFERENCE TO RELATED APPLICATION

The entire disclosure of Japanese patent application No. 2017-101902, filed on May 23, 2017, is incorporated herein by reference in its entirety.

BACKGROUND

1. Technical Field

The present invention relates to an image forming method and an image forming system.

2. Description of Related Arts

In recent years, in the printing departments of companies and print shops, color printing by a electrophotographying system called production printing machines has been utilized.

In the production printing machines, quality standards for a positional misalignment of an image is severe. During printing for a certain number of sheets, in the case where a sheet feed tray is changed, or sheets are replenished for the same tray, the position of an image on a sheet becomes different from that on previously-printed sheets, which may not satisfy the quality standards.

Hitherto, in order to prevent occurrence of such a positional misalignment of images for sheets, there has been a technique that executes deflection correction for the position of images sheets when apparatus conditions have changed so as to cause a mechanical misalignment in the sub-scanning direction due to the pull-out and insertion of a sheet feed tray or a conveyance platform (JP 2016-057542A).

SUMMARY

By the way, in the case where sheets have been changed, when image formation is performed for the front and back surfaces of one sheet, a positional misalignment between images on the front and back surfaces of the one sheet may occur due to not only a positional misalignment by a mechanical change but also a change of sheets. In the conventional techniques, consideration has not been given for a positional misalignment between images on the front and back surfaces in such a case where sheets have been changed.

Then, an object of the present invention is to provide an image forming method and an image forming system that can prevent occurrence of wasted sheets on which images on the front and back surfaces are misaligned from each other, in the case where sheets have been changed.

To achieve the above-mentioned object, according to an aspect of the present invention, an image forming method reflecting one aspect of the present invention is an image forming method for an image forming system that includes an image former that performs both side printing for one sheet and a sheet feeder that stores the sheet to be fed to the image former, the image forming method includes (a) detecting a state change of the sheet feeder; and (b) adjusting a formation position of an image to be printed on front and back surfaces of the sheet so as to eliminate a positional misalignment between images on the front and back surfaces in both side printing in a case where a state change of the sheet feeder has been detected in (a).

Moreover, to achieve the above-mentioned object, according to an aspect of the present invention, an image forming system reflecting one aspect of the present invention is an image forming system, includes an image former that performs both side printing for one sheet; a sheet feeder that stores the sheet to be fed to the image former; a reader that reads images on front and back surface of the sheet subjected to both side printing by the image former; and a processor that adjusts a formation position of an image to be printed on front and back surfaces of the sheet so as to eliminate a positional misalignment between front and back images in both side printing by controlling the image former in a case of having detected a state change of the sheet feeder.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
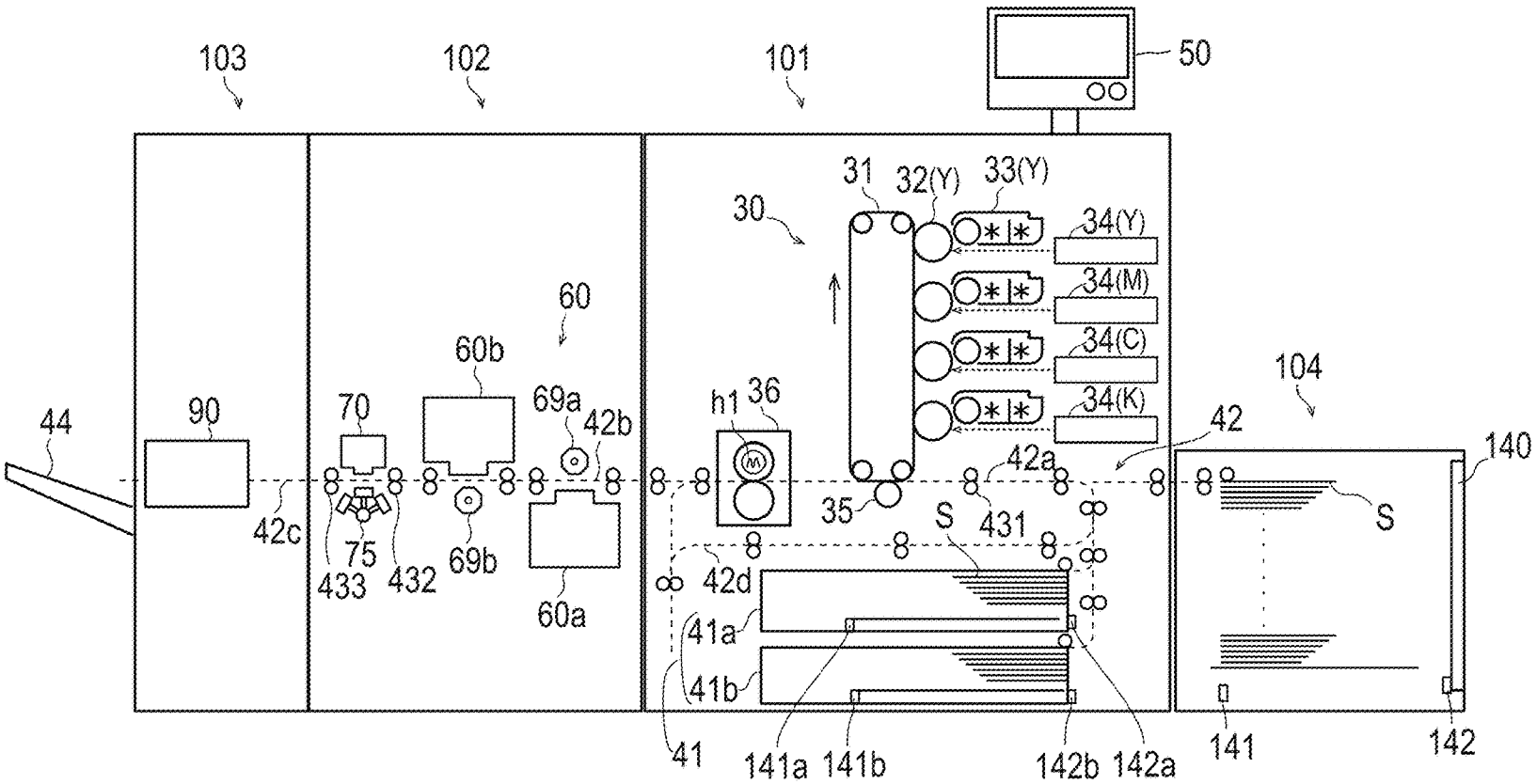
FIG. 1 is a schematic illustration showing a constitution of an image forming system according to one embodiment of the present invention.

Hereinafter, with reference to drawings, embodiments of the present invention will be described in detail. In the description for the drawings, the same element is provided with the same reference numerals, and the overlapping description will be omitted. Moreover, the dimensional ratios in the drawing are exaggerated on account of description, and, may be different from the actual ratios.

(Embodiment 1)

(Image Forming System)

Figure 2:
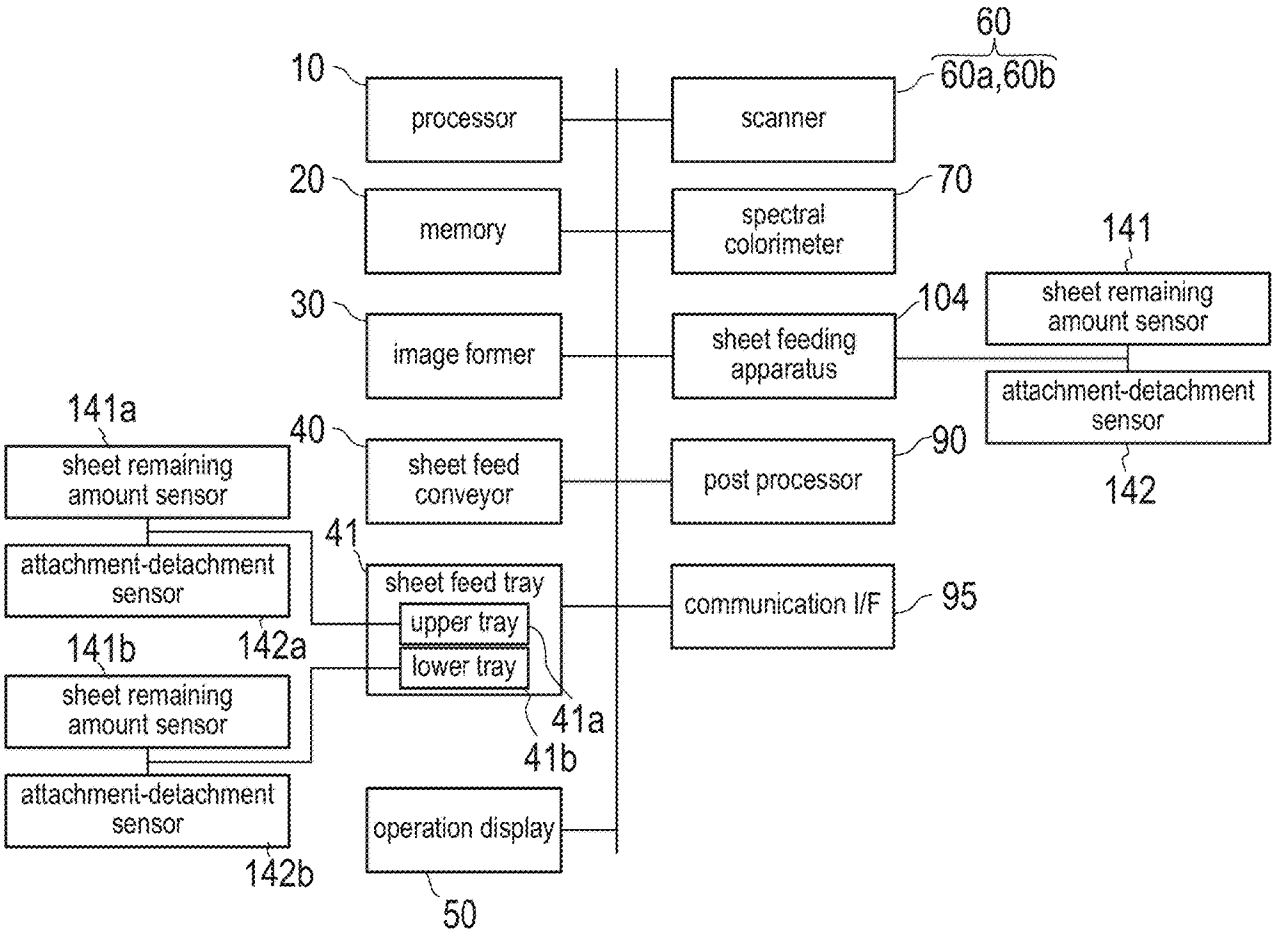
FIG. 2 is a block diagram showing a constitution of an image forming system.

FIG. 1 is a schematic illustration showing a constitution of an image forming system according to one embodiment of the present invention. FIG. 2 is a block diagram showing a constitution of an image forming system.

An image forming system 100 includes an image forming apparatus 101, a reading apparatus 102, a post processing apparatus 103, and a sheet feeding apparatus 104. The image forming apparatus 101 performs image formation (printing) for paper sheets (hereafter, merely referred to as sheets). The reading apparatus 102 reads an image on a sheet having been subjected to printing. The post processing apparatus 103 performs post processing for sheets having been subjected to printing. The sheet feeding apparatus 104 serves as a sheet feeder together with sheet feed trays 41, and stores sheets to be fed to an image former 30.

As shown in FIG. 2, the image forming system 100 includes a processor 10, a memory 20, the image former 30, a sheet feed conveyor 40, an operation display 50 (display), scanners 60*a* and 60*b* (reader 60), a spectral colorimeter 70, a post processor 90, and a communication I/F(interface) 95. These devices are connected with each other through buses for exchanging signals among them. Moreover, the sheet feeding apparatus 104 is also connected to the buses, and exchanges signals.

The processor 10 is a CPU, and, performs control for each device and various kinds of arithmetic processing in accordance with programs. Moreover, the processor 10 adjusts the color and formation position of an image on the basis of image data acquired by the scanners 60*a* and 60*b*. For example, with regard to the adjustment of the formation position of an image, edges of a sheet, trim marks, dedicated charts, and the like are read, and on the basis of the position of each of them, the formation position of an image is adjusted. In the present embodiment, the front and back surfaces of a sheet being conveyed are read at once with the two scanners 60*a* and 60*b*, and the formation position of an image on each of the front and back surfaces is adjusted (details will be mentioned later).

The memory 20 includes a ROM that stores various programs and various kinds of data beforehand, a RAM that memorizes programs and data temporarily as a work area, a hard disk that stores various programs and various kinds of data, and the like. The memory 20 memorizes image data, such as a color chart on which color patches of multiple colors for various evaluations are arranged, and a chart for front and back adjustment dedicated for adjusting the position of an image on each of front and back surfaces.

The image former 30 includes an intermediate transfer belt 31, a photoconductor drum 32, a developer 33, a writer 34, a secondary transferer 35, and a fixer 36. Each of the photoconductor drum 32, the developer 33, and the writer 34 includes the constitution corresponding to each of the basic colors of yellow (Y), magenta (M), cyan (C), and black (K). In FIG. 1, with regard to these basic colors, the notations of symbols other than a symbol 33 (Y) are omitted.

The fixer 36 includes a hollow heating roller in the inside of which a heater h1 is disposed, and a pressure applying roller which opposes the heating roller. Each roller is controlled to become a predetermined temperature (for example, 100° C. or more) by the heater h1, and, applies heating and pressing processing to a sheet.

The writer 34 of the image former 30 exposes the charged surface of the photoconductor drum 32 on the basis of image data, and, forms an electrostatic latent image. In the developer 33, the formed electrostatic latent image is developed with the toner of the developer 33, whereby the toner image of each of the basic colors is formed on the surface of a corresponding one of the photoconductor drums 32. The toner images of the basic colors are superimposed one after another on the intermediate transfer belt 31 via the primary transferers (not shown) of the respective colors, whereby a full color toner image is formed. This toner image is transferred on a sheet S via the secondary transferer 35, and thereafter, is subjected to the heating and pressing processing in the fixer 36, whereby a full color image is formed on the sheet S.

The sheet feed conveyor 40 includes a conveyance path 42 (42*a* to 42*d*), a plurality of conveyance rollers 431 to 433 etc., a drive motor (not shown) to drive these rollers, and a sheet delivery tray 44.

The sheet feed conveyor 40 rotates each of the conveyance roller 431 to 433 etc. at a predetermined timing by the drive of a drive motor, and, conveys sheets S fed from the sheet feeding apparatus 104 and sheets S fed from the sheet feed tray 41 to the image former 30.

The conveyance path 42 includes conveyance paths 42*a* and 42*d* in the image former 30, a conveyance path 42*b* in the reading apparatus 102, and a conveyance path 42*c* in the post processor 90.

A sheet S fed out from the sheet feeding apparatus 104 or the sheet feed tray 41 is conveyed on the conveyance path 42*a*. On the conveyance path 42*a*, a registration roller 431 that adjusts a conveyance timing of a sheet by rotating and stopping by a clutch, is disposed.

The sheet S that has been conveyed on the conveyance path 42*a* and has been subjected to image formation by the image former 30, is subjected to respective processes corresponding to the print setting of a print job via the conveyance paths 42*a* and 42*d* located on the downstream side, subsequently, is delivered to the outside of the apparatus, and then is placed on a sheet delivery tray 44.

Moreover, in the case where the print setting of the print job is a setting for both side printing, the sheet S on one side (a first surface, usually a front surface) of which has been subjected to the image formation, is conveyed to an ADU conveyance path 42*d* located on the lower side of the image former 30. The sheet S having been conveyed to this ADU conveyance path 42*d* is conveyed to a switch back route so that the front surface and back surface of the sheet S is reversed, and thereafter, the sheet S joins to the conveyance path 42*a*, and another surface (a second surface, usually a back surface) of the sheet S is subjected to image formation again in the image former 30.

The operation display 50 includes a display equipped with a touch panel, a ten key, a start button, a stop button, etc., and is used for inputting various kinds of settings, such as, printing conditions and an execution timing of formation position adjustment of front and back images, for displaying the state of the apparatus, and for inputting various kinds of instructions. Moreover, a user can input sheet information with respect to sheets stored in the sheet feed tray 41 through the operation display 50. Examples of the sheet information include the kind of a sheet (plain paper, fine paper, colored paper, coated paper, paper for additionally printing (already-printed paper), etc.), and the basis weight, thickness, size, etc. of a sheet. The sheet information having been input is correlated with the sheet feed tray 41 (each of the tray 41*a* and the tray 41*b*), or the sheet feeding apparatus 104, and is memorized in the memory 20.

The scanners 60*a* and 60*b* serve as the reader 60, and, are disposed on the conveyance path 42*b* so as to sandwich this conveyance path 42*b* therebetween and to read images on the different surfaces of the sheets S respectively. In the case of the setting for both side printing, the scanner 60*b* performs reading for the image on the upper side surface (the above-mentioned second surface) of the sheet S, and the scanner 60*a* performs reading for the image on the lower side surface (the above-mentioned first surface). Therefore, the both surfaces of a sheet having been subjected to the both side printing can be read by one time of conveyance. In this connection, in the case of a setting for one side printing, only the scanner 60*b* performs reading for the image on the front surface side of the sheet S.

The processor 10 performs color adjustment and image position adjustment on the basis of image data acquired by the scanner 60*a* and the scanner 60*b*. Back face members 69*a* and 69*b* are disposed at positions to face the scanners 60*a* and 60*b* respectively so as to sandwich the conveyance path 42*b* therebetween. The scanner 60*a* and the scanner 60*b* are configured with the same constitution. Moreover, the back face member 69*a* and the back face member 69*b* are also configured with the same constitution.

Each of the scanner 60*a* and the scanner 60*b* includes a line image sensor, a lens optical system, an LED (Light Emitting Diode) light source, and a casing to store these components, and, reads an image printed on a sheet being conveyed. In the reading of the image, the light from the LED light source irradiates the surface of the sheet S that passes through the reading position on the conveyance path 42*b*. The image at this reading position is led by the optical system, and, forms an image on the line image sensor, and, is read.

The spectral colorimeter 70 spectrally measures the color of each of the color patches of an image for color evaluation formed on a sheet S by the image former 30 at a position between itself and an opposite unit 75 disposed across the conveyance path 42*a*, and, acquires spectral reflectance of each wavelength in the visible light region and in its neighborhood region. The colorimetry data can be output in a color system, such as XYZ.

The post processor 90 is disposed on the conveyance path 42*c*. The post processor 90 includes, for example, a stacker and stapler that performs binding processing and stacks sheets, and, piles up a plurality of sheets S in this stacker, and thereafter, performs side stitching processing using staples in the stapler. A bundle of sheets S having been subjected to the side stitching are delivered on the sheet delivery tray 44. Moreover, sheets S having been not subjected to the side stitching are delivered via the conveyance path 42*c* as they are.

As the communication interface 95, various kinds of local connecting interfaces, for example, network interfaces according to standards such as SATA, PCI ExpreS, USB, Ethernet (registered trademark), and IEEE 1394, and wireless-communications interfaces such as Bluetooth (registered trademark), and IEEE802.11, etc. may be used. A print job including print data and print setting is received from external terminals, such as PC and the like through the communication interface 95.

The sheet feeding apparatus 104 and the upper tray 41*a* and the lower tray 41*b* of the sheet feed tray 41 each serves as a sheet feeder. Accordingly, in the present embodiment, a plurality of sheet feeders is provided.

The sheet feeding apparatus 104 stores more sheets than each of the trays 41*a* and 41*b* of the inside of the image forming-apparatus 101. In the sheet feeding apparatus 104, a sheet remaining amount sensor 141 is disposed with which a sheet remaining amount is measured, and the measured sheet remaining amount is sent to the processor 10. Moreover, in the sheet feeding apparatus 104, a door 140 is provided for a casing, and replenishing, changing, and the like of sheets are performed by opening the door 140. The opening and closing of the door 140 is detected by an opening and closing sensor 142, and signals are sent to the processor 10.

The sheet feed tray 41 in this embodiment is a two-stage drawer type tray including the upper tray 41*a* and the lower tray 41*b*, and attachment-detachment sensors 142*a* and 142*b* are provided for detecting the attachment and detachment of each tray so that the attachment and detachment state of each of the trays 41*a* and 41*b* is detected and is sent to the processor 10. Moreover, sheet remaining amount sensors 141*a* and 141*b* are also provided for measuring the sheet remaining amount in each of the tray 41*a* and 41*b* so that the sheet remaining amount of each of the trays 41*a* and 41*b* is detected and is sent to the processor 10. The number of trays is not limited to the two stages, but may be one stage, or may be three or more stages. Moreover, sheet feed trays are not provided in the inside of the image forming apparatus 101, and only a sheet feeding apparatus (including a sheet feeding apparatus with multistage trays) may be used.

(Automatic Adjustment of Front and Back Image Positions)

An example of automatic adjustment of front and back image positions is described.

At the time of executing adjustment of the formation position of each of front and back images (henceforth, referred to as "front and back adjustment"), the processor 10 makes each of the sheet feeding apparatus 104, the upper tray 41*a*, and the lower tray 41*b* where a change of sheets has been made, convey a sheet therefrom, and prints a chart for front and back adjustment on the front and back surfaces of the sheet. The image data of the chart for front and back adjustment is memorized beforehand in the memory 20.

Figure 3:
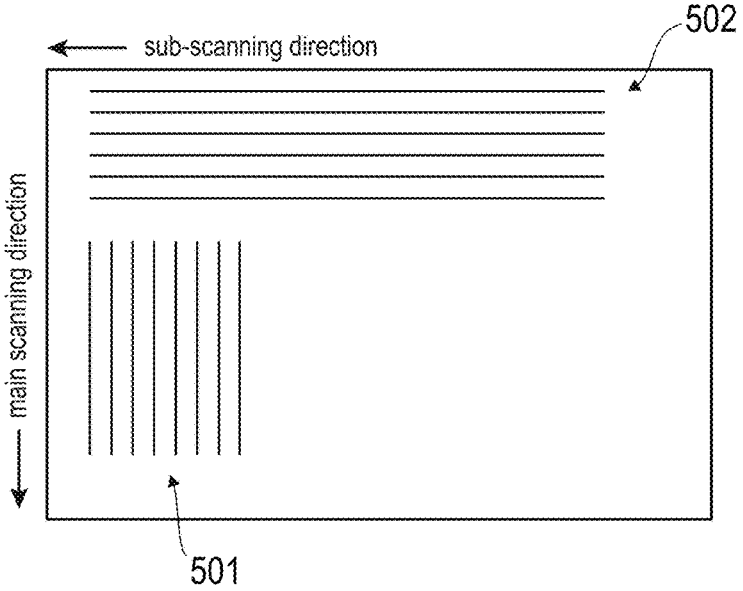
FIG. 3 is a surface view of a sheet on which an example of a chart for front and back adjustment is printed.

FIG. 3 is a surface view of a sheet on which an example of a chart for front and back adjustment is printed. As shown in FIG. 3, on the chart for front and back adjustment, lines 501 arranged at regular intervals in the sheet conveyance direction (sub-scanning direction) and lines 502 arranged at regular intervals in the direction (main scanning direction) orthogonal to the sheet conveyance direction are printed. In this connection, these charts are merely one example, and other than these charts, for example, images in which line intervals change at a predetermined rate may be used.

A sheet on each of the both surfaces of which this chart for front and back adjustment has been printed, is sent to the reading apparatus 102, and the front and back surfaces of the sheet are read with the scanners 60*a* and 60*b* by one time of conveyance. The processor 10 determines misalignment amounts on the basis of the read positions of the lines 501 and lines 502 from the chart of the read front surface and the chart of the read back surface. Then, the processor 10 adjusts the formation position of an image in each of the main scanning direction and the sub-scanning direction so as to correspond to the misalignment amounts. In concrete terms, for example, the formation position of an image is adjusted so as to eliminate the positional misalignment by making an image drawing timing on the back surface earlier or later, or, shifting an image drawing position on the back surface with respect to the front surface. Again, the chart for front and back adjustment is subjected to both side printing, and then, a positional misalignment between the images on the front and back surfaces is checked. By repeating this operation until it is confirmed that there is no position misalignment, it becomes possible to perform both side printing with no positional misalignment between front and back images.

(Image Forming Method)

The processing procedure for performing the front and back adjustment in the image forming system 100 in Embodiment 1 is described.

Figure 4:
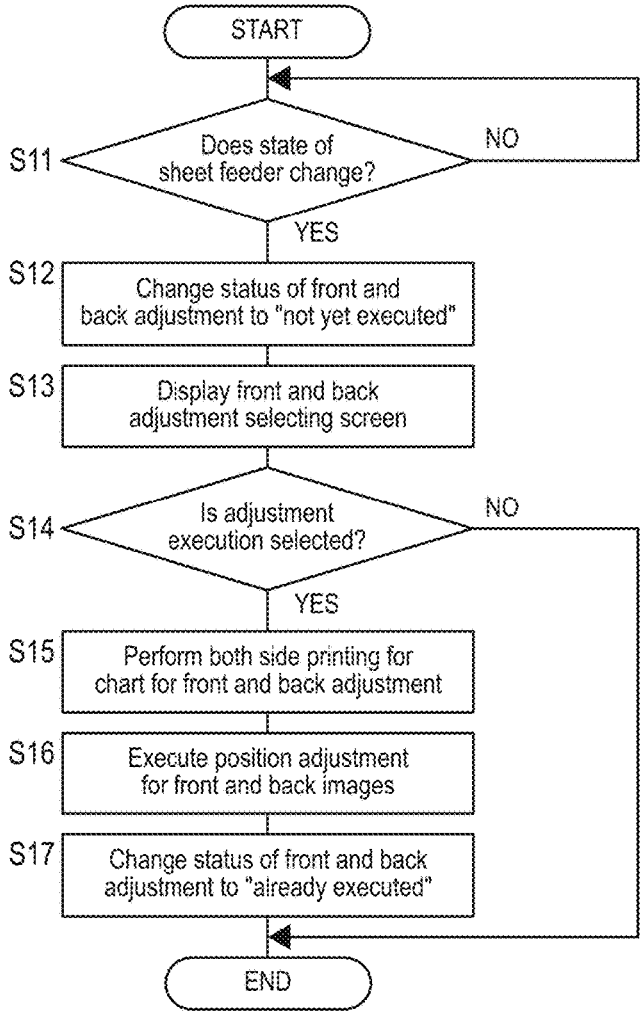
FIG. 4 is a flowchart showing a processing procedure for performing front and back adjustment in Embodiment 1.

FIG. 4 is a flowchart showing the processing procedure for performing the front and back adjustment in Embodiment 1.

First, the processor 10 determines whether there has been any change in any one of the sheet feeding apparatus 104 and the sheet feed tray 41 (the trays 41*a* and 41*b*) (sheet feeder state change: S11). This step is made to detect that the state of the sheet feeder has been changed. Examples of the state of the sheet feeder include a case where the door 140 of the sheet feeding apparatus 104 has been opened and closed, a case where the sheet feed tray 41 (each of the trays 41*a* and 41*b*) has been reinstalled after having been pulled out, a case where the matter that the sheet remaining amount has changed (in particular, increased) has been detected by the sheet remaining amount sensors 141, 141*a*, and 141*b*, and a case where the sheet information has been changed. With regard to the opening and closing of the door 140 of the sheet feeding apparatus 104, the attachment and detachment of each of the trays 41*a* and 41*b* of the sheet feed tray 41, and the sheet remaining amount by the sheet remaining amount sensors 141, 141*a*, and 141*b*, these items are detected on the basis of signals from each of the sensors in the system. On the other hand, with regard to the sheet information, it is an input of a setting change from the operation display 50. The sheet information is set for each of the trays (including the sheet feeder) with regard to sheets stored in a corresponding tray. Accordingly, the sheet information is also referred to as tray setting information.

In the case where there is no change in S11 (S11: NO), this processing will become a standby state. Here, with regard to the existence/no-existence of mechanical changes on such a system, the occurrence of them is made to an event, which causes that this processing procedure will be executed by interruption processing.

Figure 5:
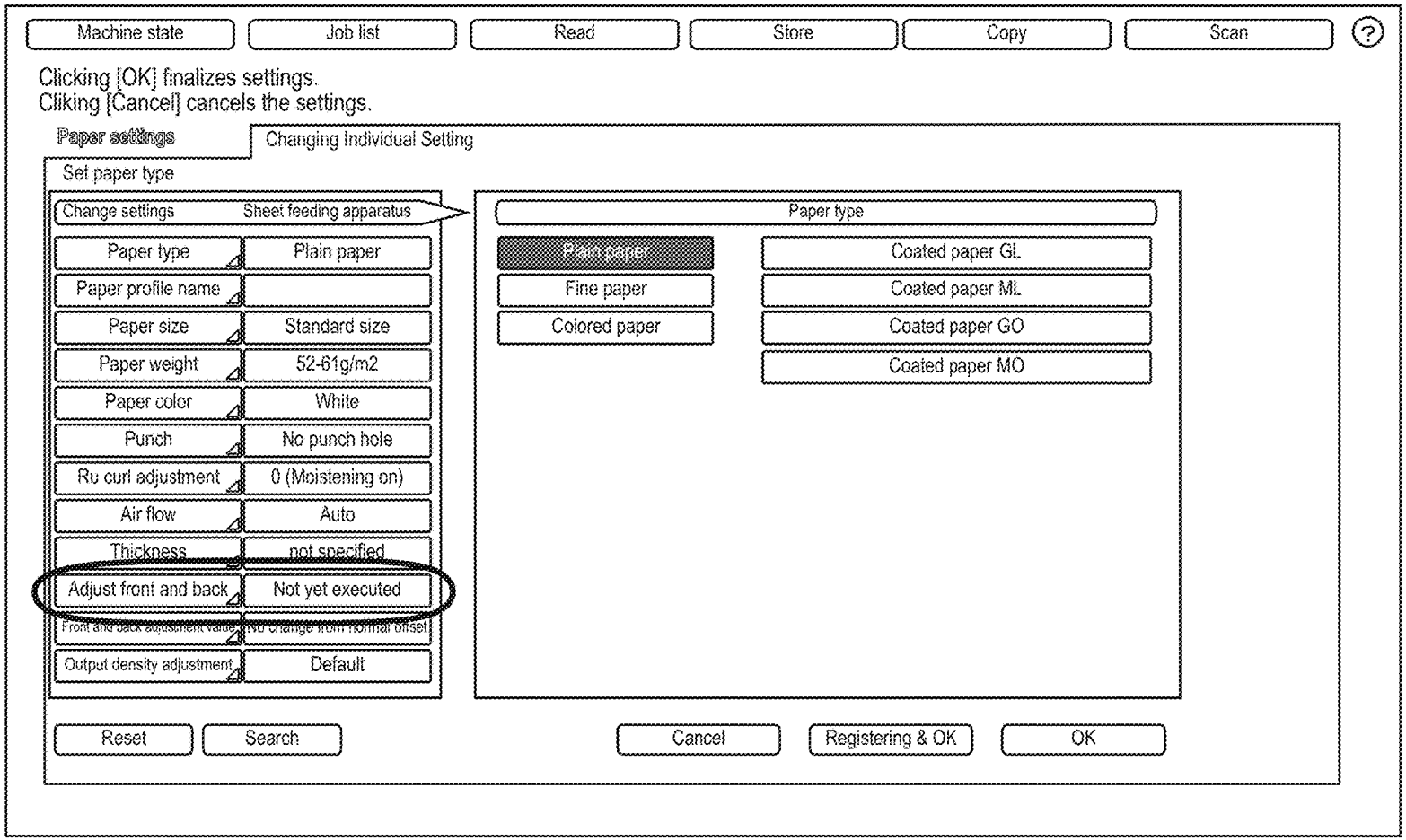
FIG. 5 is a screen example illustration showing an example of a sheet setting screen.

In the case where there has been a change in any one of the sheet feeding apparatus 104 and the sheet feed tray 41 (S11: YES), the processor 10 changes the status of the front and back adjustment to "not yet executed" (S12). With regard to the status of the front and back adjustment, for example, a sheet setting screen is displayed on the operation display 50, and the status of the front and back adjustment is indicated as one of items on the sheet setting screen. FIG. 5 is a screen example illustration showing an example of the sheet setting screen. The example of the sheet setting screen shown in FIG. 5 is a screen displayed immediately after the sheets in the "sheet feeding apparatus" has been changed. At this stage, the item showing the front and back adjustment is indicated as "not yet executed" (in FIG. 5, a portion enclosed with an ellipse). Although the setting of the sheet information (tray setting information) after the changing of the sheets is also performed from this screen, the state shown in FIG. 5 is the state before the changing of the setting (with regard to after the changing of the setting, refer to FIG. 6 and FIG. 7). In this connection, the sheet information having been already described is set by being input from this sheet setting screen. Since the status of S12 usually has been made to "already executed" by the previous front and back adjustment, this status is changed to "not yet executed", and the changed status is memorized in the memory 20.

Figure 6:
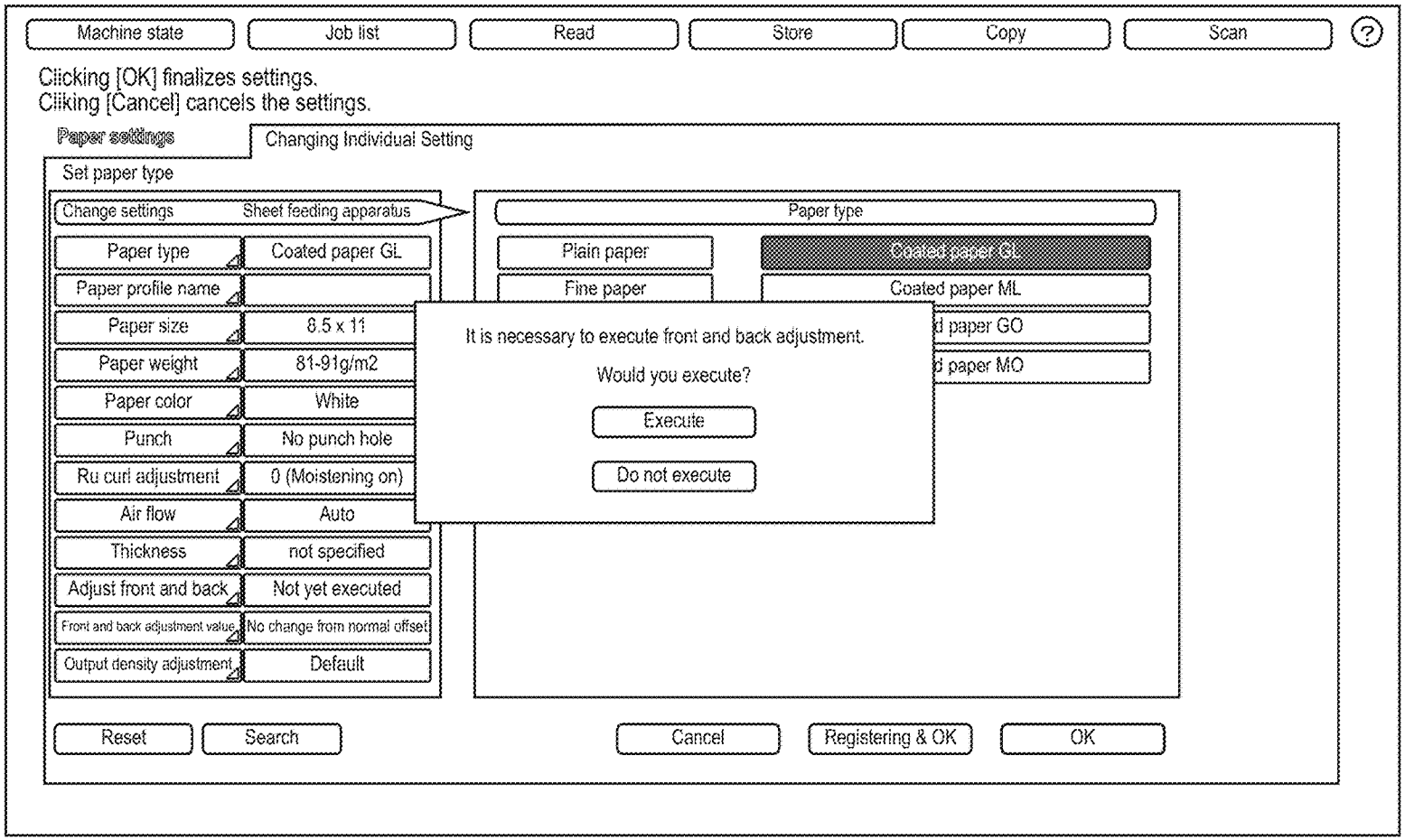
FIG. 6 is a screen example illustration showing an example of a front and back adjustment selecting screen.

Successively, the processor 10 makes the operation display 50 display a front and back adjustment selecting screen (S13). FIG. 6 is a screen example illustration showing an example of the front and back adjustment selecting screen. As shown in FIG. 6, in the example of this front and back adjustment selecting screen, the front and back adjustment selecting screen is displayed as a popup screen on the screen having been displayed on the operation display 50 at the time point in S13. The contents displayed on the popup screen indicate that it is necessary to execute the front and back adjustment, and also indicate the selection buttons of "Execute" and "Do not execute" for the front and back adjustment. In this regard, the screen example shown in FIG. 6 shows the state where coated paper GL has been selected as the sheet setting after the changing of sheets.

Successively, the processor 10 determines whether the front and back adjustment is to be executed or not (S14). Here, in the case where "Do not execute" is selected from the front and back adjustment selecting screen of the operation display 50 (S14: NO), this processing procedure is ended as it is. In the case where the processing procedure is ended in this state, it results in that the status of the front and back adjustment remains "not yet executed". Accordingly, for a person who has used this system after that, it turns out that the front and back adjustment has not been executed.

On the other hand, in the case where "Execute" is selected from the front and back adjustment selecting screen of the operation display 50 in S14 (S14: YES), it is assumed that an instruction for the automatic adjustment of front and back image positions has been given from a user, the processor 10 performs both side printing for a chart for front and back adjustment (S15). Then, the processor 10 executes adjustment of front and back image positions (S16). These S15 and S16 are as having already described.

Figure 7:
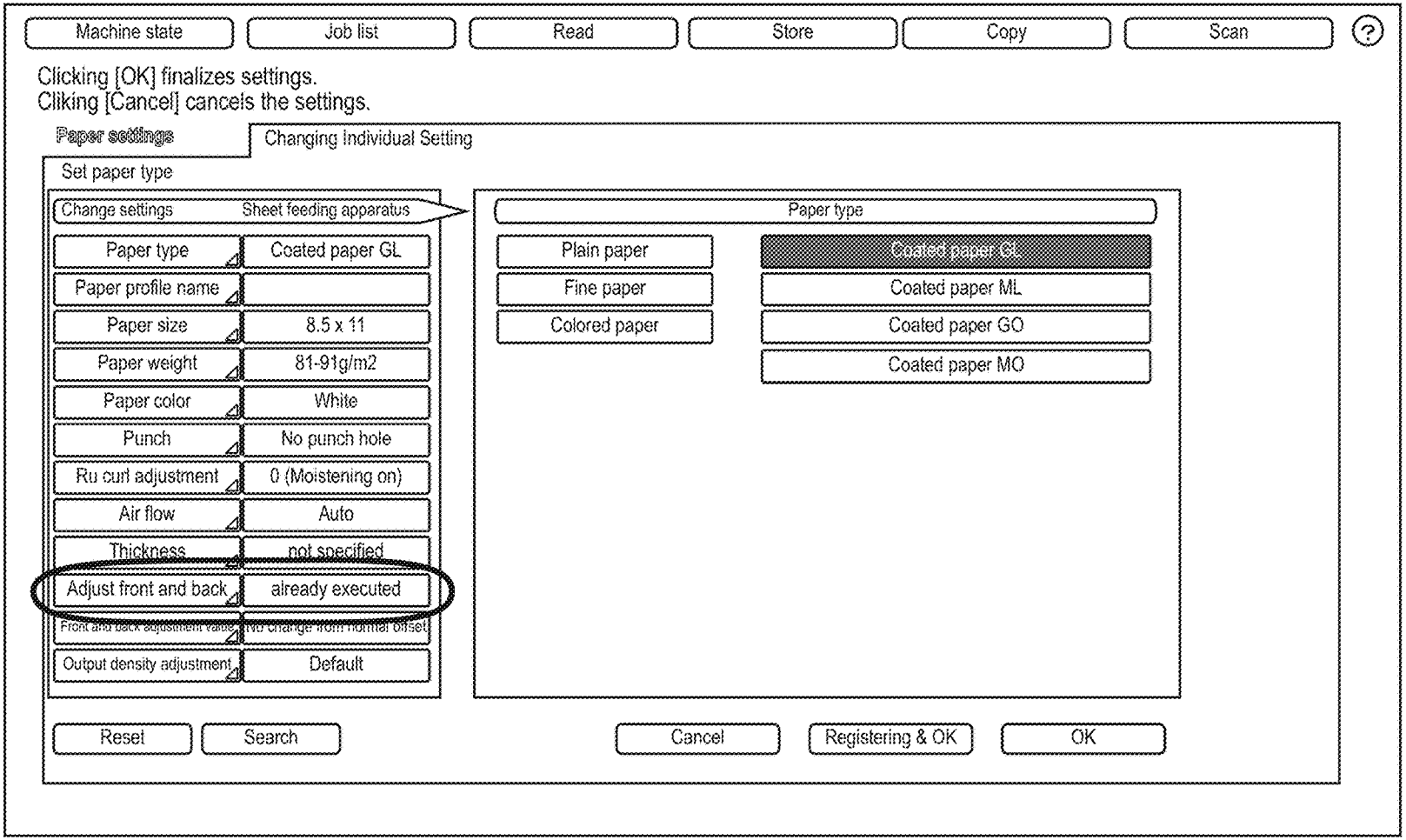
FIG. 7 is a screen example illustration showing an example of a sheet setting screen.

In the case where the automatic adjustment of front and back image positions has been finished, the processor 10 changes the status of the front and back adjustment to "already executed" (S17). With regard to the status of the front and back adjustment, for example, the sheet setting screen is displayed on the operation display 50, and the status of the front and back adjustment is indicated as one of items displayed on the sheet setting screen. FIG. 7 is a screen example illustration showing an example of the sheet setting screen. As shown in FIG. 7, the item which shows the same front and back adjustment as shown in FIG. 6, becomes "already executed" by the processing in S17 (in FIG. 7, a portion enclosed with an ellipse). With regard to the status of S17, the status memorized as "not yet executed" in S12 is overwritten with "already executed", and the overwritten status is memorized in the memory 20.

With the above, after the front and back adjustment, the processing is ended. Henceforth, by looking the sheet setting screen corresponding to the sheet feeding apparatus 104 and each of the trays 41*a* and 41*b*, it turns out that the front and back adjustment is executed for each of the sheet feeding apparatus 104, the tray 41*a*, and the tray 41*b*.

Any one of opening and closing of the door 140 of the sheet feeding apparatus 104, attachment and detachment of each of the trays 41*a* and 41*b* of the sheet feed tray 41, a change of the sheet remaining amount by the sheet remaining amount sensors 141, 141*a*, and 141*b*, and changing of the sheet information (tray setting information) is a signal or an input (changing of the setting) which shows the possibility that the sheets have been changed. For this reason, in the present embodiment, in the case where these signal and inputs occur, it is assumed that the sheet having been supplied until now has been changed to another sheet, that is, it is assumed that the possibility that the sheet having been already subjected to the front and back adjustment is changed to a sheet having been not subjected to the front and back adjustment, is very high, the front and back adjustment is made to be executed. However, although these presumption work, in preparation for a case of merely having replenished the same kind of sheet, and a case where a user thinks primarily that a misalignment between the image positions on the front and back surfaces may be permissible, it is made possible to select not to execute the front and back adjustment in S14.

As mentioned above, in the present Embodiment 1, a mechanical change of the image forming system 100 in association with the changing of sheets, or the detection of the changing of the sheet information is made to a trigger, and then, the front and back image positions are adjusted. With this, in the case of changing sheets, it is possible to prevent a user from forgetting to adjust front and back image positions, and as a result, it becomes possible to prevent the occurrence of wasted sheets on which images on the front and back surfaces are misaligned.

In this connection, in the processing procedure mentioned above, it is made possible for a user to select whether the front and back adjustment is executed or not (S13, S14). This is a step prepared for a case where the one side printing is wanted to be executed instantly after changing sheets. However, this step may not exist, and in the case where sheets are changed, the front and back adjustment may be made to be necessarily executed at that time. Moreover, in the case where the sheet remaining amount in the sheet feeder (the sheet feeding apparatus 104 and the sheet feed tray 41) increases (that is, it is a case where sheets are replenished), a user may be made to select whether the front and back adjustment is executed or not.

Moreover, here, it is premised that sheets to be provided for printing from now on are stored in the sheet feeder. However, there may be a case where already-printed sheets for additionally printing are stored in the sheet feeder, so that there is no need to consider a positional misalignment on a displayed image in both side printing. In such a case, the front and back adjustment may be made not to be performed. Whether the already-printed sheets are stored in the sheet feeder, for example, may be set as a sheet kind etc. at the time of setting the sheet information for the sheet feeder. Moreover, in the case where a tray dedicated for sheet insertion is selected as the sheet feeder, whether sheets are already-printed sheets or not may be made to be selected. In the case where already-printed sheets are stored in this way, it is not necessary to set the status to "Not yet executed".

(Embodiment 2)

The image forming method according to Embodiment 2 is described. Embodiment 2 is only different in processing procedure from Embodiment 1, and since the constitution of the image forming system is the same as Embodiment 1, description for it is omitted.

Figure 8:
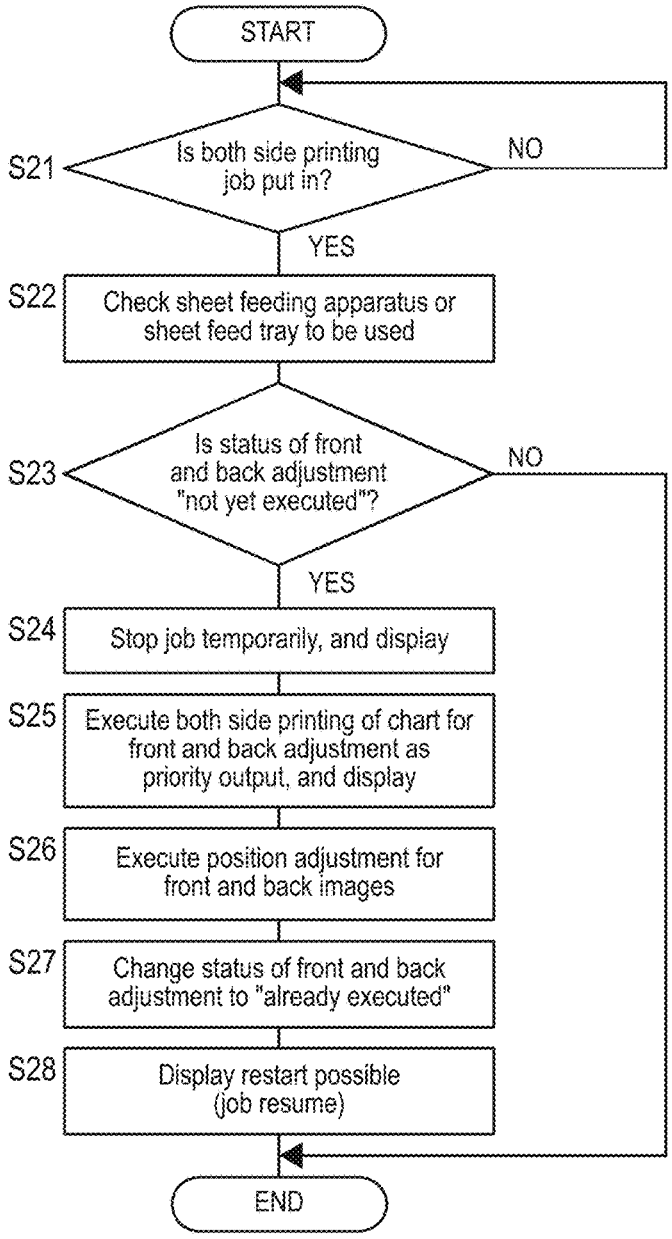
FIG. 8 is a flowchart showing a processing procedure for performing automatic adjustment for front and back image positions in Embodiment 2.

FIG. 8 is a flowchart showing the processing procedure for performing automatic adjustment for front and back image positions in Embodiment 2.

First, the processor 10 determines whether a both side printing job is put in (S21). Here, in the case where the both side printing job is not put in (S11: NO), the processing becomes a standby state. In this connection, in the case where a one side printing job is put in, a usual one side printing will be performed as it is.

Here, in the case where a both side printing job is put in (S21: YES), the processor 10 checks the sheet feeding apparatus 104 or the sheet feed tray 41 (each of the trays 41*a* and 41*b*) to be used for printing of the put-in job (S22). With this checking, it is determined whether the status of the front and back adjustment memorized in the memory 20 is "not yet executed" or not (S23). The status of the front and back adjustment is as having described in Embodiment 1. Here, in the case where the status is not "not yet executed" (i.e., "already executed") (S23: NO), this processing is ended, and the usual printing will be performed.

Figure 9:
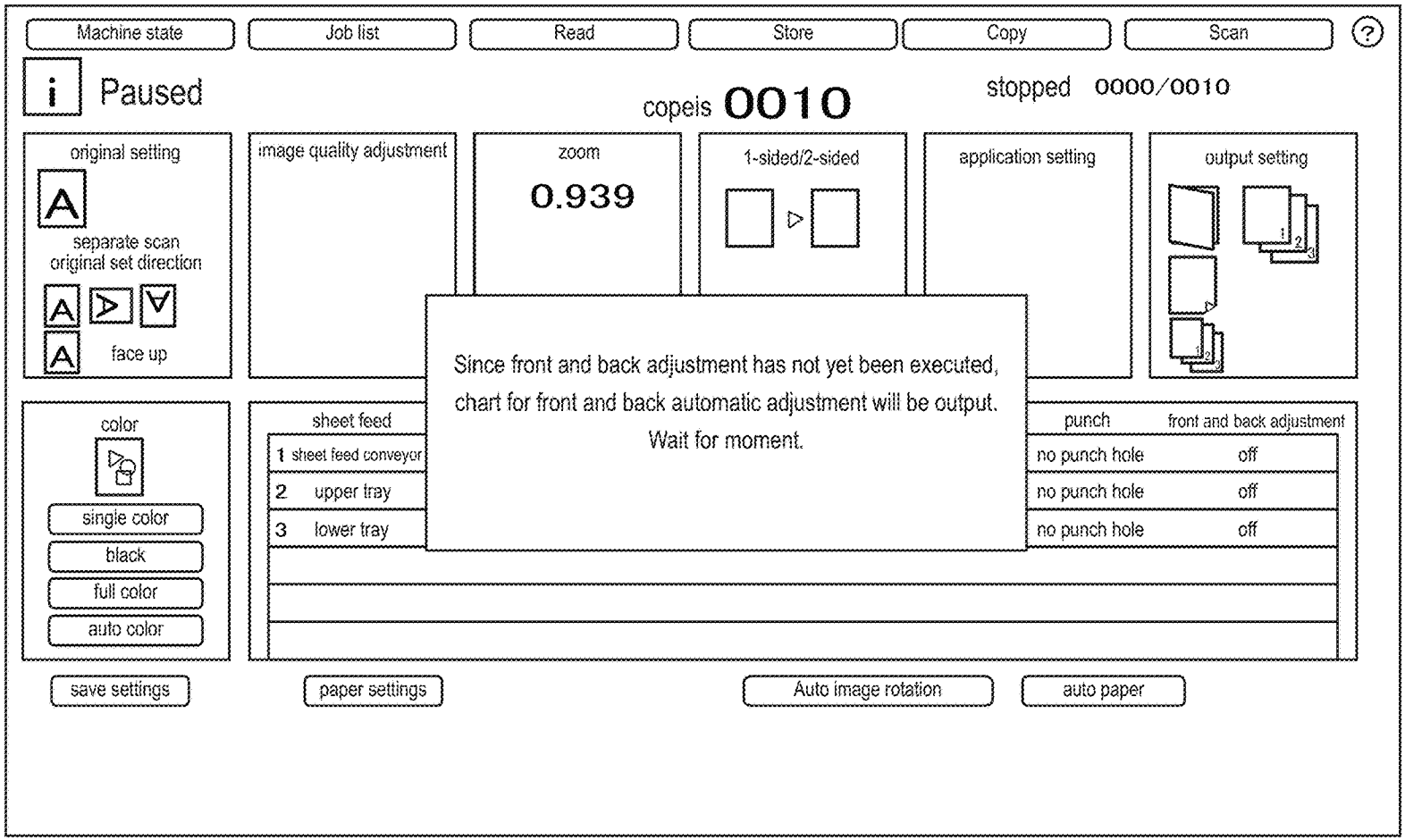
FIG. 9 is a screen example illustration showing an example at the time of displaying the stopping of a job.

On the other hand, in the case where the status is "not yet executed" (S23: YES), the printing of the put-in job is stopped temporarily, and, in addition, the message that a job is stopped, is indicated (S24). This indication is displayed on the operation display 50. FIG. 9 is a screen example illustration showing an example at the time of displaying the stopping of a job. As shown in FIG. 9, in this example of the screen, it is displayed that the job is stopped temporarily, and, in addition, the message that since the front and back adjustment has not yet been executed, the front and back adjustment is executed, is displayed on a popup screen.

Figure 10:
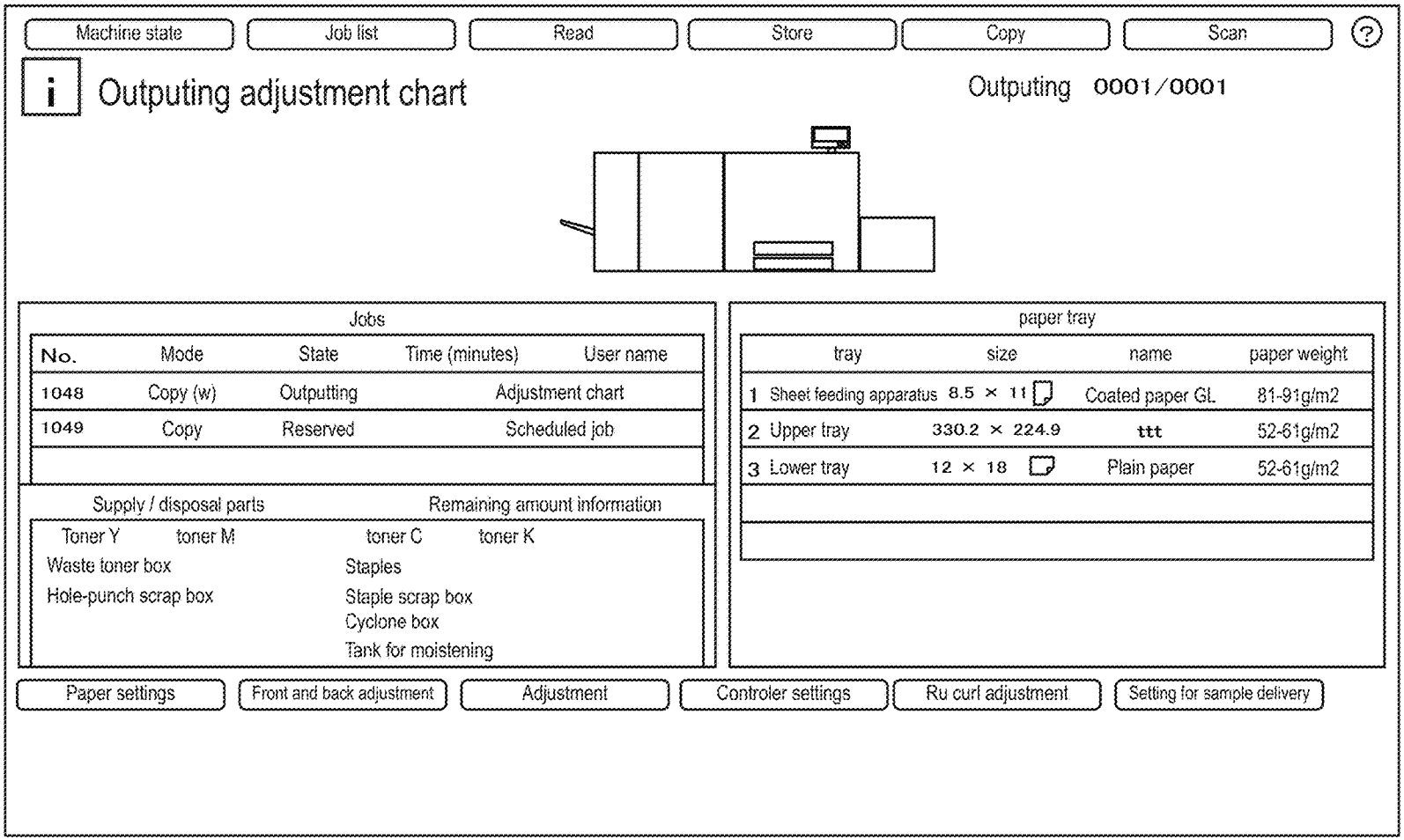
FIG. 10 is a screen example illustration showing that a chart for front and back adjustment is under output.

Successively, the processor 10 performs the both side printing of a chart for front and back adjustment as a priority output, and, displays such a matter (S25). The reason why it is made to the priority output is that even in the case where the other job is put in, the printing of the chart for front and back adjustment is to be performed. FIG. 10 is a screen example illustration showing that a chart for front and back adjustment is under output. As shown in FIG. 10, it is displayed that a chart for front and back adjustment is under output.

Successively, the processor 10 executes the adjustment for front and back image positions (S26). These S25 and S26 are as having already described.

In the case where the automatic adjustment for the front and back image positions has been finished, the processor 10 changes the status of the front and back adjustment to "already executed" (S27). The status of the front and back adjustment is the same as that having been described in Embodiment 1.

Figure 11:
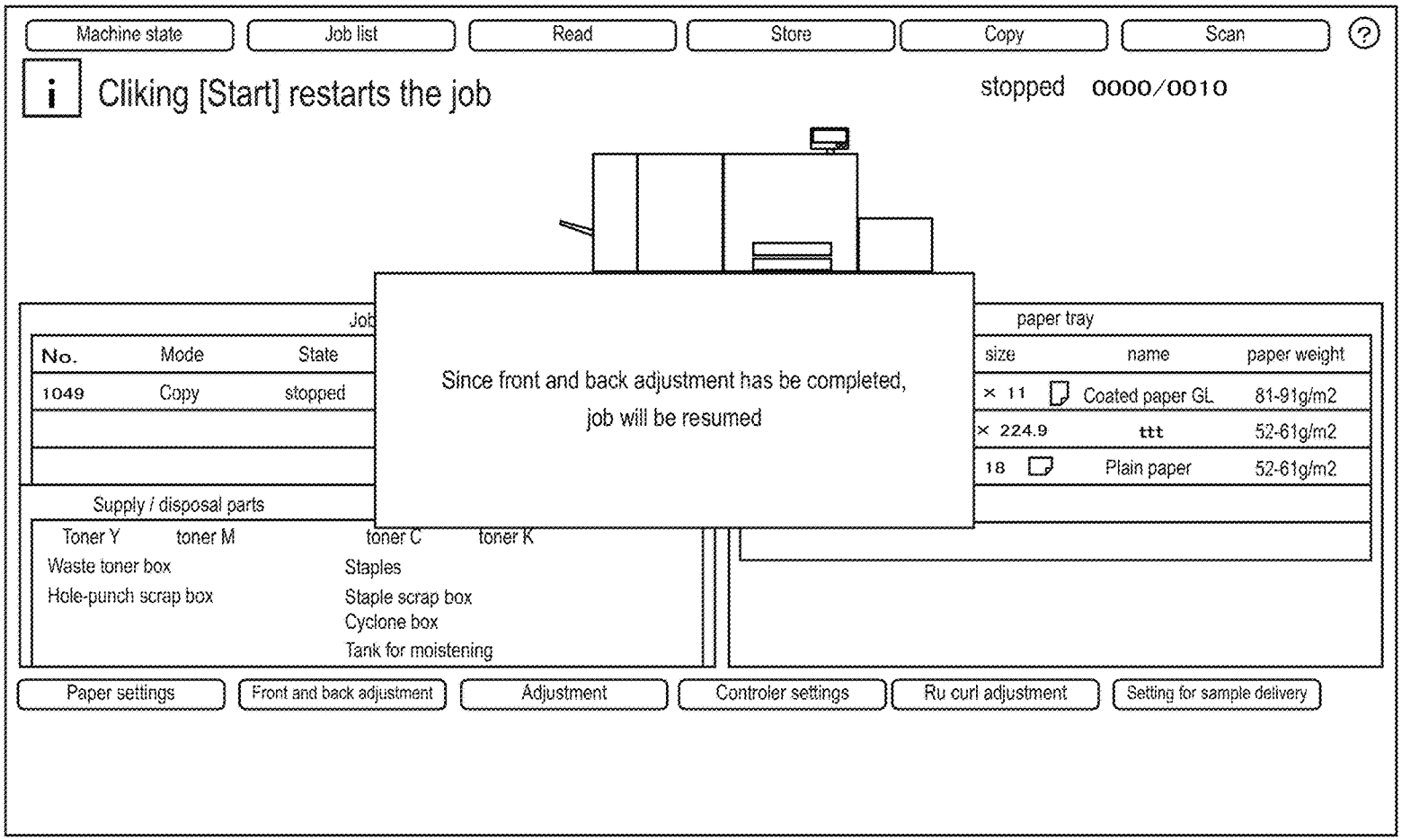
FIG. 11 is a screen example illustration showing an example of a restart possible screen.

Successively, the processor 10 displays that it is possible to restart the job (S28). FIG. 11 is a screen example illustration showing an example of a restart possible screen. As shown in FIG. 11, it is displayed that restart can be performed by the input of a "start" key, and, in addition, the message that since the front and back adjustment has been completed, the job is resumed, is displayed on a popup screen.

After that, this processing is ended, and the usual printing will be performed.

As mentioned above, in the present Embodiment 2, when a job of both side printing is put in, it is determined whether the front and back adjustment has been already executed, and in the case where the front and back adjustment is "not yet executed", the front and back adjustment is executed, and thereafter, both side printing is made to be performed. For this reason, even if the front and back adjustment has not yet been performed at the time point when a change of sheets has been made, since the automatic adjustment for front and back image positions is performed before both side printing is performed, it is possible to prevent a user from forgetting to perform front and back adjustment and performing both side printing, and as a result, it becomes possible to prevent the occurrence of wasted sheets on which images on the front and back surfaces are misaligned.

In this connection, in the present embodiment 2, in the case where a job for both side printing is put in, if front and back adjustment has not yet been executed, the front and back adjustment is executed. The reason is that since it is not necessary in one side printing to consider misalignment between images on the front and back surfaces, the whole of this processing procedure is not performed at the time of putting in one side printing so that the one side printing is made to be able to be executed instantly. However, in the system that performs both side printing, there is a possibility that both side printing is performed thereafter. Accordingly, when a job is put in, the put-in may be made to a trigger so that front and back adjustment may be executed irrespective of a difference whether the job is one-side or both-side printing.

Although the embodiments have been described in the above, the present invention should not be limited to these embodiments.

In the embodiments mentioned above, the description has been given for the case where the sheet is changed in the sheet feeding apparatus 104. However, in the case where the sheet is changed in the upper tray 41*a* or the lower tray 41*b* in the image forming apparatus 101, this can be executed similarly for each tray.

Moreover, even in the case where the image forming system 100 or the image forming apparatus is not equipped with the sheet feeding apparatus 104 of a large capacity, this can be applicable. Moreover, the scanners 60*a* and 60*b* may be incorporated in the image forming apparatus 101.

Moreover, in the case where a job for one side printing is put in, a user may be made to be able to select whether front and back adjustment is to be executed or not. Moreover, the number of the scanners 60*a* in the reading apparatus 102 may be one. In this case, after the printing for the front surface, the printed image on the front surface may be read by the one scanner 60*a*, and, after the printing for the back surface, the printed image on the back surface may be read by the one scanner 60*a*.

In addition, in the present invention, on the basis of the constitution described in the claims, various modifications can be made, and such modifications are included in the scope of the present invention.

Although embodiments of the present invention have been described and illustrated in detail, the disclosed embodiments are made for purpose of illustration and example only and not limitation The scope of the present invention should be interpreted by terms of the appended claims.

What is claimed is:

1. An image forming method for an image forming system that includes an image former that performs both side printing for one sheet and a sheet feeder that stores the sheet to be fed to the image former, the image forming method comprising:

a detecting step of detecting a state change of the sheet feeder; and an adjusting step of adjusting a formation position of an image to be printed on front and back surfaces of the sheet so as to eliminate a positional misalignment between images on the front and back surfaces in both side printing in a case where a state change of the sheet feeder has been detected in the detecting step, wherein in a case where, in the detecting step, a change of a sheet remaining amount has been detected as a state change of the sheet feeder, whether to execute the adjusting step is inquired of a user, and in a case where an instruction has been given so as to execute the adjusting step, the adjusting step is executed.

2. The image forming method of claim 1, wherein in the detecting step, at least any one of a case where a door attached to the sheet feeder has been opened or closed, a case where a tray of the sheet feeder has been pulled out or inserted, a case where a remaining amount of the sheet stored in the sheet feeder has changed, and a case where sheet information for the sheet stored in the sheet feeder has been changed, is detected as a state change of the sheet feeder.

3. The image forming method of claim 1, wherein the adjusting step includes printing a chart for front and back adjustment for adjusting a formation position of an image to be printed on front and back surfaces of the sheet.

4. The image forming method of claim 1, wherein the adjusting step is executed before printing a print job of both side printing.

5. The image forming method of claim 1, wherein in a case where a print job of one side printing has been put in after the detecting step, whether to execute the adjusting step is inquired of a user, and in a case where an instruction has been given so as to execute the adjusting step, the adjusting step is executed.

6. The image forming method of claim 1, wherein in a case where the sheet having been already printed is stored in the sheet feeder, the adjusting step is not executed.

7. The image forming method of claim 1, wherein the image forming system includes a display, wherein the display displays a matter that position adjustment for front and back images has not yet been executed after a state change of the sheet feeder has been detected in the detecting step until the adjusting step is executed, and wherein the display displays a matter that position adjustment for front and back images has been already executed after the adjusting step has been executed.

8. The image forming method of claim 1, wherein as the sheet feeder, a plurality of sheet feeders is provided, and the detecting step and the adjusting step are performed correspondingly to each of the plurality of sheet feeders individually.

9. An image forming system, comprising:

an image former that performs both side printing for one sheet;

a sheet feeder that stores the sheet to be fed to the image former;

a reader that reads images on front and back surfaces of the sheet subjected to both side printing by the image former; and a processor that adjusts a formation position of an image to be printed on front and back surfaces of the sheet so as to eliminate a positional misalignment between front and back images in both side printing by controlling the image former in a case of having detected a state change of the sheet feeder, wherein in a case of having detected a change of a sheet remaining amount as a state change of the sheet feeder, the processor inquires of a user whether or not to adjust a formation position of an image to be printed on front and back surfaces of the sheet, and in a case where an instruction has been given so as to execute adjustment, the processor controls the image former to adjust a formation position of an image to be printed on front and back surfaces of the sheet.

10. The image forming system of claim 9, wherein in a case of at least any one of a case where a door attached to the sheet feeder has been opened or closed, a case where a tray of the sheet feeder has been pulled out or inserted, a case where a remaining amount of the sheet stored in the sheet feeder has changed, and a case where sheet information for the sheet stored in the sheet feeder has been changed, the processor determines that a state of the sheet feeder has changed.

11. The image forming system of claim 9, wherein the processor makes the image former print a chart for front and back adjustment for adjusting a formation position of an image to be printed on front and back surfaces of the sheet.

12. The image forming system of claim 9, wherein the processor controls the image former so as to adjust a formation position of an image to be printed on front and back surfaces of the sheet after having detected a state change of the sheet feeder before printing a print job of both side printing.

13. The image forming system of claim 9, wherein in a case where a print job of one side printing has been put in after having detected a state change of the sheet feeder, the processor inquires of a user whether or not to adjust a formation position of an image to be printed on front and back surfaces of the sheet, and in a case where an instruction has been given so as to execute adjustment, the processor makes the image former adjust a formation position of an image to be printed on front and back surfaces of the sheet.

14. The image forming system of claim 9, wherein in a case where the sheet having been already printed is stored in the sheet feeder, the processor does not execute adjustment for a formation position of an image to be printed on front and back surfaces of the sheet.

15. The image forming system of claim 9, further comprising a display, wherein until executing adjustment for a formation position of an image to be printed on front and back surfaces of the sheet after having detected a state change of the sheet feeder, the processor displays on the display a matter that position adjustment for front and back images has not yet been executed, and after having executed adjustment for a formation position of an image to be printed on front and back surfaces of the sheet, the processor displays on the display a matter that position adjustment for front and back images has been already executed.

16. The image forming system of claim 9, wherein as the sheet feeder, a plurality of sheet feeders is provided, and, in a case of having detected a state change of the sheet feeder correspondingly to each of the sheet feeders individually, the processor controls the image former so as to adjust a formation position of an image to be printed on front and back surfaces of the sheet.

17. An image forming system, comprising:

an image former that performs both side printing for one sheet;

a sheet feeder that stores the sheet to be fed to the image former;

a reader that reads images on front and back surfaces of the sheet subjected to both side printing by the image former; and a processor that adjusts a formation position of an image to be printed on front and back surfaces of the sheet so as to eliminate a positional misalignment between front and back images in both side printing by controlling the image former in a case of having detected a state change of the sheet feeder, wherein in a case where a print job of one side printing has been put in after having detected a state change of the sheet feeder, the processor inquires of a user whether or not to adjust a formation position of an image to be printed on front and back surfaces of the sheet, and in a case where an instruction has been given so as to execute adjustment, the processor makes the image former adjust a formation position of an image to be printed on front and back surfaces of the sheet.

18. An image forming system, comprising:

an image former that performs both side printing for one sheet;

a sheet feeder that stores the sheet to be fed to the image former;

a reader that reads images on front and back surfaces of the sheet subjected to both side printing by the image former; and a processor that adjusts a formation position of an image to be printed on front and back surfaces of the sheet so as to eliminate a positional misalignment between front and back images in both side printing by controlling the image former in a case of having detected a state change of the sheet feeder, wherein in a case where the sheet having been already printed is stored in the sheet feeder, the processor does not execute adjustment for a formation position of an image to be printed on front and back surfaces of the sheet.

* * * * *